US011369545B1

(12) United States Patent
He

(10) Patent No.: US 11,369,545 B1
(45) Date of Patent: Jun. 28, 2022

(54) SWINGING TOUCH MASSAGE DEVICE

(71) Applicant: Shenzhen S-Hande Technology Co., Ltd., Shenzhen (CN)

(72) Inventor: Jing He, Shenzhen (CN)

(73) Assignee: SHENZHEN S-HANDE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/553,733

(22) Filed: Dec. 16, 2021

(30) Foreign Application Priority Data

Dec. 9, 2021 (CN) ..... 202123091616.9

(51) Int. Cl.

| | |
|---|---|
| ***A61H 23/02*** | (2006.01) |
| ***A61H 7/00*** | (2006.01) |
| ***A61H 19/00*** | (2006.01) |
| ***A61H 9/00*** | (2006.01) |

(52) U.S. Cl.
CPC ..... *A61H 23/0263* (2013.01); *A61H 7/00* (2013.01); *A61H 7/005* (2013.01); *A61H 9/0057* (2013.01); *A61H 9/0071* (2013.01); *A61H 19/30* (2013.01); *A61H 19/32* (2013.01); *A61H 19/40* (2013.01); *A61H 19/44* (2013.01);

(Continued)

(58) Field of Classification Search
CPC ..... A61H 23/0263; A61H 7/00; A61H 2201/1246; A61H 2201/149; A61H 19/00; A61H 19/30; A61H 19/32; A61H 19/34; A61H 19/40; A61H 19/44; A61H 19/50; A61H 21/00; A61H 7/005; A61H 9/0057; A61H 9/0071; A61H 7/001; A61H 7/002
See application file for complete search history.

(56) References Cited

U.S. PATENT DOCUMENTS 5,085,207 A * 2/1992 Fiore ..... A61H 23/0254 601/134
5,460,597 A * 10/1995 Hopper ..... A61H 19/30 601/134

(Continued)

FOREIGN PATENT DOCUMENTS

CN 204890546 U * 12/2015
CN 108743300 A * 11/2018

(Continued)

OTHER PUBLICATIONS

English translation for CN 108743300, espacenet.com, translated on Feb. 23, 2022.*

(Continued)

*Primary Examiner* — Tu A Vo

(57) ABSTRACT

A swinging touch massage device includes a housing and a swing member received in the housing, the swing member including a rotary motor, a reversing member and a swing rod, two opposite ends of the reversing member respectively connected with the rotary motor and the swing rod, the reversing member configured to convert a rotary motion of the rotary motor into a reciprocating swing of the swing rod; a massage protrusion is arranged at one end of the swing rod away from the reversing member, and protrudes outwardly from a surface of the housing to swing back and forth with the swing rod. The massage device provides swing touch massage and improve massage experience without being jammed.

9 Claims, 20 Drawing Sheets

(52) U.S. Cl.
CPC ..... *A61H 2201/0153* (2013.01); *A61H 2201/1246* (2013.01); *A61H 2201/149* (2013.01)

(56) References Cited

U.S. PATENT DOCUMENTS

| | | | | | |
|---|---|---|---|---|---|
| 5,470,303 | A * | 11/1995 | Leonard | A61H 19/34 | 600/38 |
| 9,889,064 | B1 * | 2/2018 | Olivares | A61H 19/40 | |
| 2012/0253246 | A1 * | 10/2012 | Yamazaki | A61H 23/006 | 601/101 |
| 2014/0309565 | A1 * | 10/2014 | Allen | A61H 19/44 | 601/46 |
| 2015/0148592 | A1 * | 5/2015 | Kanbar | A61H 19/34 | 600/38 |
| 2015/0359703 | A1 * | 12/2015 | Richardson, II | A61H 19/44 | 600/38 |

FOREIGN PATENT DOCUMENTS

| | | | | | |
|---|---|---|---|---|---|
| JP | 2006110289 | A * | 4/2006 | A61H 19/40 | |
| WO | WO-2016056666 | A1 * | 4/2016 | A61H 19/00 | |
| WO | WO-2019072718 | A1 * | 4/2019 | | |

OTHER PUBLICATIONS

English translation for JP 2006110289, espacenet.com, translated on Feb. 23, 2022.*
English translation for CN 204890546, espacenet.com, translated on Feb. 25, 2022.*

* cited by examiner

SWINGING TOUCH MASSAGE DEVICE

BACKGROUND

1. Technical Field

The present disclosure generally relates to the field of massage devices, and especially relates to a swinging touch massage device.

2. Description of Related Art

Many kinds of massage devices are provided for massaging and relaxing the human body through mechanical or electrical stimulation. A conventional massage device generally beats and touches the human body to massage the human body through a motor vibration mode or a rotation mechanism, however, experience feeling of the motor vibration mode is single, and the reciprocating beating mode of the rotation mechanism is easy to be jammed, which results in poor usage experiences.

Therefore, the conventional massage device needs to be improved.

SUMMARY

The technical problems to be solved: in view of the shortcomings of the related art, the present disclosure relates to a swinging touch massage device which can provide swing touch massage and improve massage experience without being jammed.

The technical solution adopted for solving technical problems of the present disclosure is:

a swinging touch massage device includes a housing and a swing member received in, the housing;

the swing member including a rotary motor, a reversing member and a swing rod, two opposite ends of the reversing member respectively connected with the rotary motor and the swing rod, the reversing member configured to convert, a rotary motion of the rotary motor into a reciprocating swing of the swing rod; and wherein a massage protrusion is arranged at one end of the swing rod away from the reversing member, and protrudes outwardly from a surface of the housing to swing back and forth with the swing rod.

Wherein the reversing member is an eccentric shaft, the swing rod is a nozzle member, the nozzle member including a rotation fulcrum rotationally connected with the housing, and a mouth structure, located on a first edge of the rotation fulcrum, the massage protrusion arranged on an opposite second edge of the rotation fulcrum; and a first portion of the eccentric shaft connected with the rotary motor, an opposite second portion of the eccentric shaft extending into the mouth structure, the eccentric shaft rotated to drive the mouth structure to move linearly back and forth, so that the whole nozzle member swings around the rotation fulcrum.

Wherein the mouth structure includes a first rod and an opposite second rod arranged on the nozzle member, and a movable cavity formed between the first rod and the second rod, the eccentric shaft extending into the movable cavity and in contact with the first rod and the second rod back and forth during a rotation process thereof, so that the mouth structure moves linearly back and forth.

Wherein the eccentric shaft includes a first shaft and a second shaft eccentrically arranged on the first shaft, the first shaft connected with the rotary motor, and the second shaft extending into the movable cavity of the mouth structure.

Wherein a height of the movable cavity is greater than or equal to a diameter of the second shaft, and a width of the movable cavity is greater than or equal to a distance from the leftmost position to the rightmost position of a rotation track of the second shaft.

Wherein the nozzle member includes a rotating support pipe that is taken as the rotation fulcrum located in a middle thereof, and a first swing bar and a second swing bar respectively arranged on a sidewall of the rotating support pipe, the rotating support pipe rotationally installed on the housing, the mouth structure arranged at one end of the first swing bar away from the rotating support pipe, and the massage protrusion arranged on the second swing bar.

Wherein a first vibration motor is arranged on a distal end of the second swing bar, the massage protrusion is a hollow structure, and sleeved on the first vibration motor.

Wherein the massage protrusion is a tongue-shaped configuration or a finger-shaped configuration.

Wherein a bell-shaped cover is arranged on one end of the housing, and the massage protrusion is exposed outside from the cover.

Wherein the housing includes a hard shell and a soft shell sleeved on the hard shell, an opening arranged on one end of the hard shell, the swing rod extending outside from the opening to provide with the massage protrusion, and the cover arranged adjacent to the opening.

Wherein the cover is integrated with the soft shell, or all the cover, the soft shell and the massage protrusion are integrated with each other.

Wherein the cover is an independent structure and detachably connected with both the soft shell and the hard shell.

Wherein an air pump is installed in the housing, a suction hole arranged at a connection end of the housing and the cover, and a suction pipe connected between the suction hole and the air pump.

Wherein an outlet is arranged at the connection end of the housing and the cover, and an outlet pipe is connected between the outlet and the air pump.

Wherein the housing is a rod-shaped configuration, and a second vibration motor is arranged on an end of the rod-shaped housing away from the massage protrusion.

Wherein the hard shell is made of plastic, and the soft shell is made of silica gel; both a key and a charging interface respectively arranged on a surface of the soft shell, the swing member arranged in the hard shell, both a battery and a circuit board received in the hard shell, and the battery configured to supply power to the circuit board and the swing member.

It should be understood that, within the scope of the present disclosure, the above technical features of the present disclosure and the technical features specifically described below (such as embodiments) can be combined with each other to form a new or preferred technical, solution, which is not described here in detail due to space limitations.

The swinging touch massage device of the present disclosure is provided that all the rotary motor, the reversing member and the swing rod are set as the swing member to be received in the housing, the massage protrusion arranged on the swing rod, the reversing member connected with the rotary motor and the swing rod, so that the rotary motion of the rotary motor is converted into the reciprocating swing of the swing rod, so as to drive the massage protrusion of the swing rod to swing back and forth for massaging the human body, in this way, the massage device of the present disclosure performs swing touch massage through the swing member, which will not cause stagnation, and has better vibration massage effect compared with a single motor vibration, so as to improve usage experiences.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Obviously, the drawings described below, are some embodiments of the present disclosure, for one of ordinary skill in the related art, other drawings can be obtained according to the drawings below on the premise of no creative work.

Figure 1:
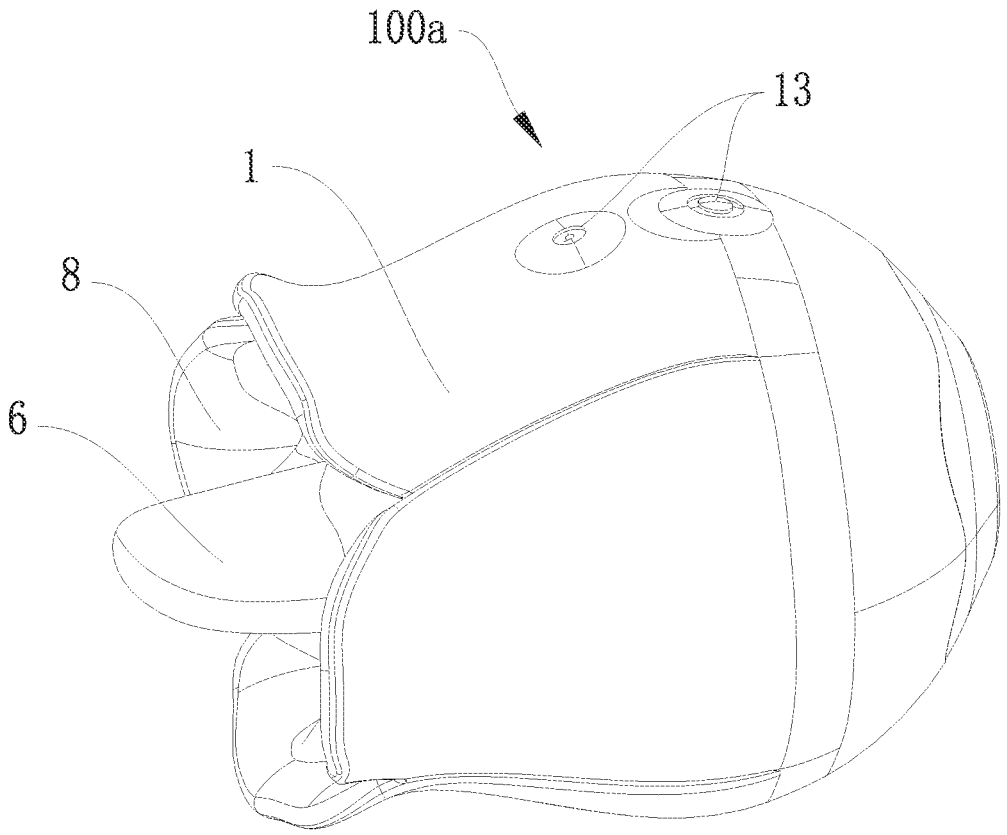
FIG. 1 is a schematic view of a swinging touch massage device in accordance with a first embodiment of the present disclosure.

The element labels according to the exemplary embodiment of the present disclosure shown as below:

100*a*, 100*b*, 100*c*, 100*d* massage device, 1 housing, 1*a* surface, 1*b* end, 11 hard shell, 111 first hard shell, 1111 rotating shaft, 112 second hard shell, 113 opening, 114 frame, 12 soft shell, 12*a* surface, 13 key, 14 charging interface, 15 battery, 16 circuit board, 2 swing member, 3 rotary motor, 4 reversing member, 40 eccentric shaft, 40*a* first portion, 40*b* second portion, 41 first shaft, 42 second shaft, 5 swing rod, 50 nozzle member, 50*a* first end, 50*b* second end, 51 rotation fulcrum, 51*a* first edge, 51*b* second edge, 511 rotating support pipe, 52 first swing bar, 52*a* an end, 53 second swing bar, 53*a* distal end, 54 mouth structure, 541 first rod, 542 second rod, 543 movable cavity, 55 sleeve, 6 massage protrusion, 61 base, 71 first vibration motor, 72 second vibration motor, 8 cover, 80 chamber, 91 air pump, 92 suction hole, 93 suction pipe, 94 outlet, 95 outlet pipe, 96 vent.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment, in the description is a part of the present disclosure implementation examples, rather than the implementation of all embodiments, examples. According to the described embodiment of the present disclosure, all, other embodiments obtained by one of ordinary skill in the related art on the premise of no creative work are within the protection scope of the present disclosure.

In the description of the present disclosure, it needs to be explained that all the directional indicators (such as the terms: "upper", "below", "left", "right", "front", "back" . . . ), are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

In the description of the present disclosure, except where specifically otherwise illustrated or limited, the terms "connect" and "link" used herein should be understood in a broad sense. Such as, the meaning may be tight connection, removable connection, or integrated connection. The meaning may also be mechanical connection, electrical connection, direct connection or indirect connection through intermediaries, or internal connection within two elements. The meaning of the terms used herein may be understood by one of ordinary skill in the related art according to specific conditions of the present, disclosure.

Furthermore, in the description of the present disclosure, the terms such as "first" and "second" shown in the specification are only used to describe, but not indicated that the elements of the present disclosure is important or represented the amount of the elements. That is, the features limited by the terms of "first" and "second" may explicitly or implicitly include one or more features.

Referring to FIGS. 1-9, a swinging touch massage device 100*a* in accordance with a first embodiment of the present disclosure includes a housing 1 and a swing member received in the housing 1.

Specifically, the housing 1 includes a hard shell 11 and a soft shell 12 sleeved on the hard shell 11. The hard shell 11 can be made of plastic and other materials, and the soft shell 12 can be made of silica gel and other materials. A key 13 and a charging interface 14 are respectively arranged on a surface 12*a* of the soft shell 12, the swing member 2 arranged in the hard shell 11, both a battery 15 and a circuit board 16 received in the hard shell 11, and the battery 15 configured to supply power to the circuit board 16 and the swing member 2.

Figure 4:
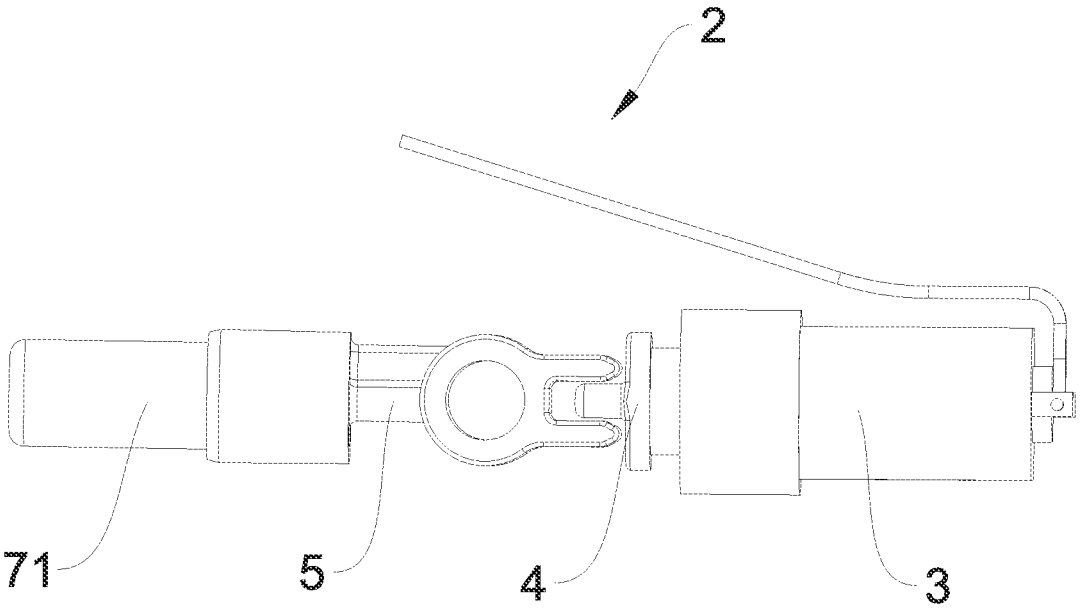
FIG. 4 is a schematic view of a swing member of the swinging touch massage device of FIG. 2.
Figure 5:
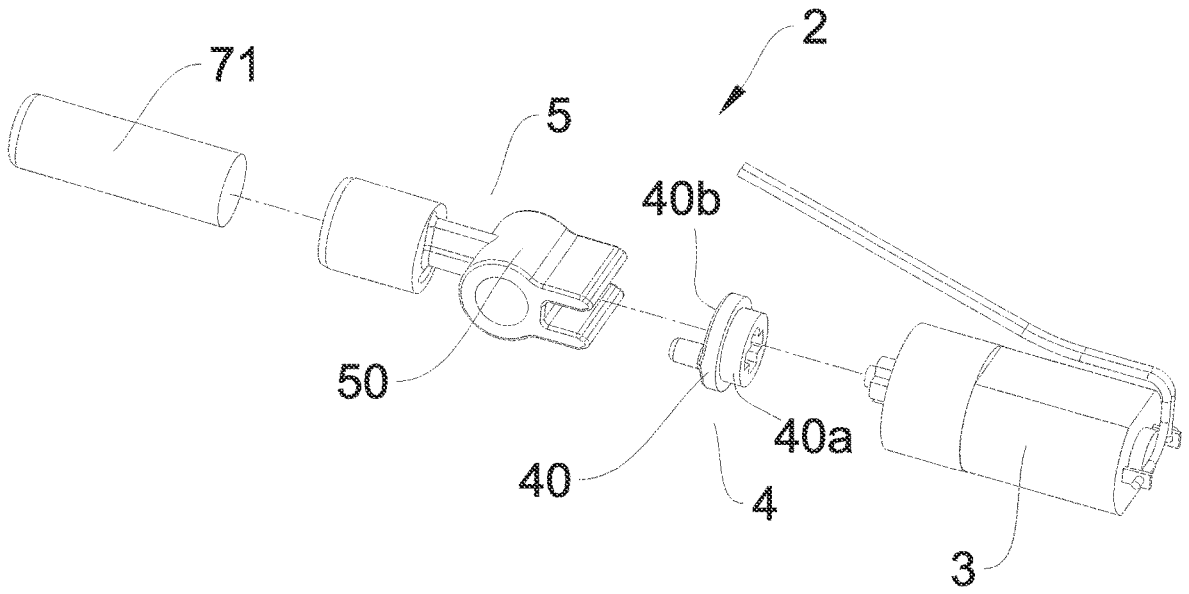
FIG. 5 is an exploded, schematic view of the swing member of the swinging touch massage device of FIG. 4.

Referring to FIG. 4 and FIG. 5, in the first embodiment of the present disclosure, the swing member 2 includes a rotary motor 3, a reversing member 4 and a swing rod 5, two opposite ends of the reversing member 4 respectively connected with the rotary motor 3 and the swing rod 5, the reversing member 4 configured to convert a rotary motion of the rotary motor 3 into a reciprocating swing of the swing rod 5. The reversing member 4 can be adopted for an eccentric mechanism or a crank slider to convert the rotary motion into a linear reciprocating motion. A swing fulcrum of the swing rod 5 can be two opposite edges (such as a first edge and an opposite second edge) of the swing rod 5 or a middle position of the swing rod 5. The rotary motor 3 is powered by the battery 15 and controlled to be started or stopped by the circuit board 16.

Figure 3:
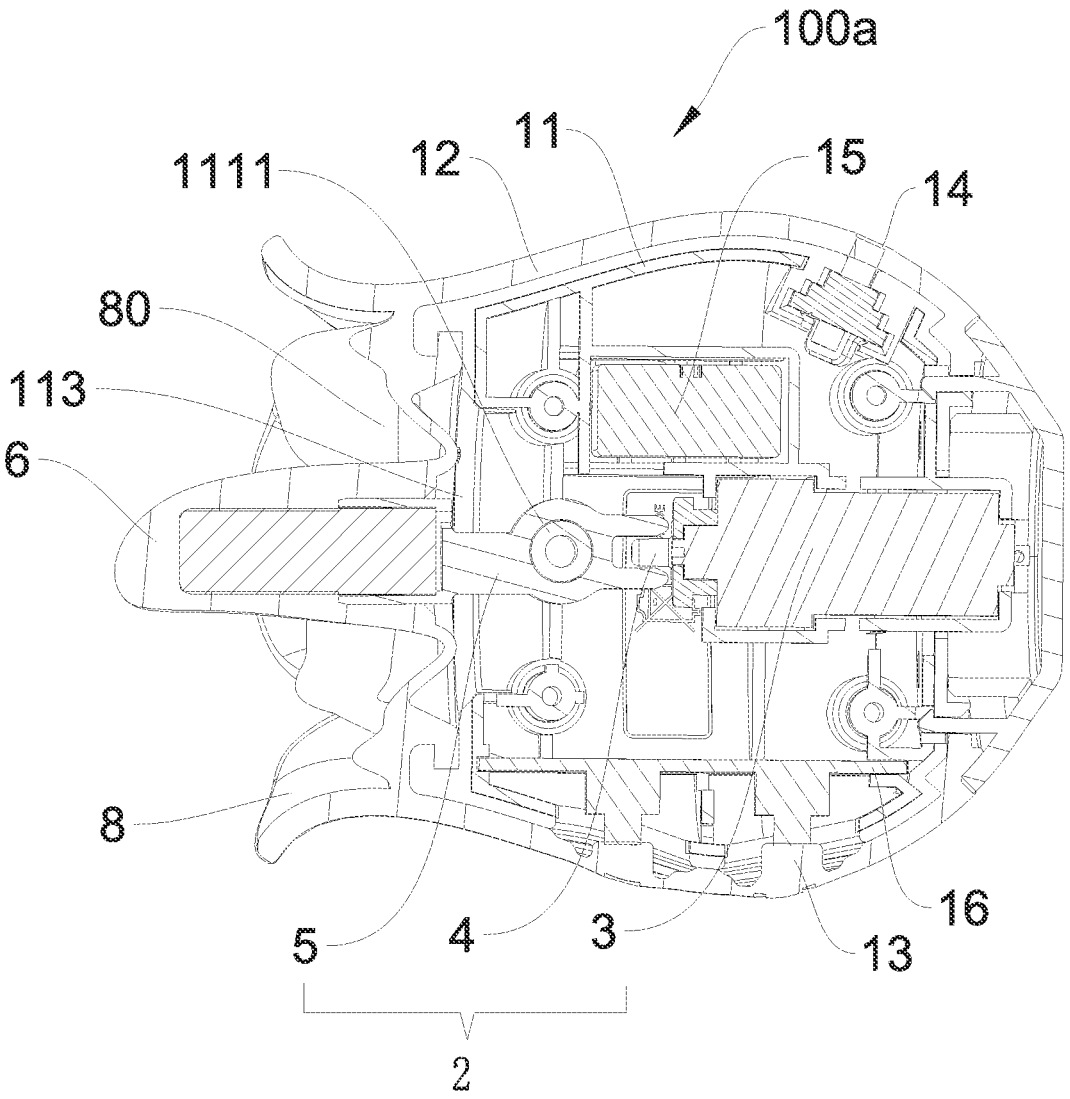
FIG. 3 is a cross section view of the swinging touch massage device of FIG. 1.

Referring to FIG. 3, a massage protrusion 6 is arranged at one end of the swing rod 5 away from the reversing member 4, and protrudes outwardly from a surface 1*a* of the housing 1 to swing back and forth with the swing rod 5. The rotary motor 3 starts to rotate, due to provide the reversing member 4, the rotation motion of the rotary motor 3 is output to the swing rod 5 and then converted into a linear reciprocating movement by the swing rod 5, such as up and down reciprocating, or left and right reciprocating, or back and forth reciprocating, etc, thus, the swing rod 5 swings back and forth around the swing fulcrum thereof, to further drive the massage protrusion 6 that has been arranged on the swing rod 5 to swing back and forth, so as to swing and touch the human body. Compared with the reciprocating beating, massage of the rotation mechanism in the related art, the swing member 2 of the present disclosure can't be jammed, and can be stably and reliably operated. At the same time, the reciprocating swing of the massage protrusion 6 has a better massage effect than the vibration massage of a single motor, so that user's experiences are improved.

In an embodiment of the present disclosure, the hard shell 11 includes a first hard shell 111 and a second hard shell 112, one end that the first hard shell 111 is connected with the second hard shell 112 is provided with an opening 113, the swing rod 5 extends outside from the opening 113, and the massage protrusion 6 is arranged on an extending part of the swing rod 5 that has been extended out of the opening 113. The opening 113 is arranged so that the swing rod 5 that is received in the opening 113 extends therefrom to connect with the massage protrusion 6 for driving further the massage protrusion 6 to swing.

Preferably, the massage protrusion 6 is a hollow structure, so that the massage protrusion 6 can be directly surrounded around the swing rod 5. In an embodiment of the present disclosure, the massage protrusion 6 and the soft shell 12 are integrated with each other for sealing the extending part of the swing rod 5 that has been extended from the opening 113 of the hard shell 11.

Furthermore, the massage protrusion 6 of the first embodiment is a tongue-shaped configuration, it can be understood that the massage protrusion 6 can also be a finger-shaped configuration, which can simulate a tongue or fingers of the human body to swing and touch massage the human body.

Figure 6:
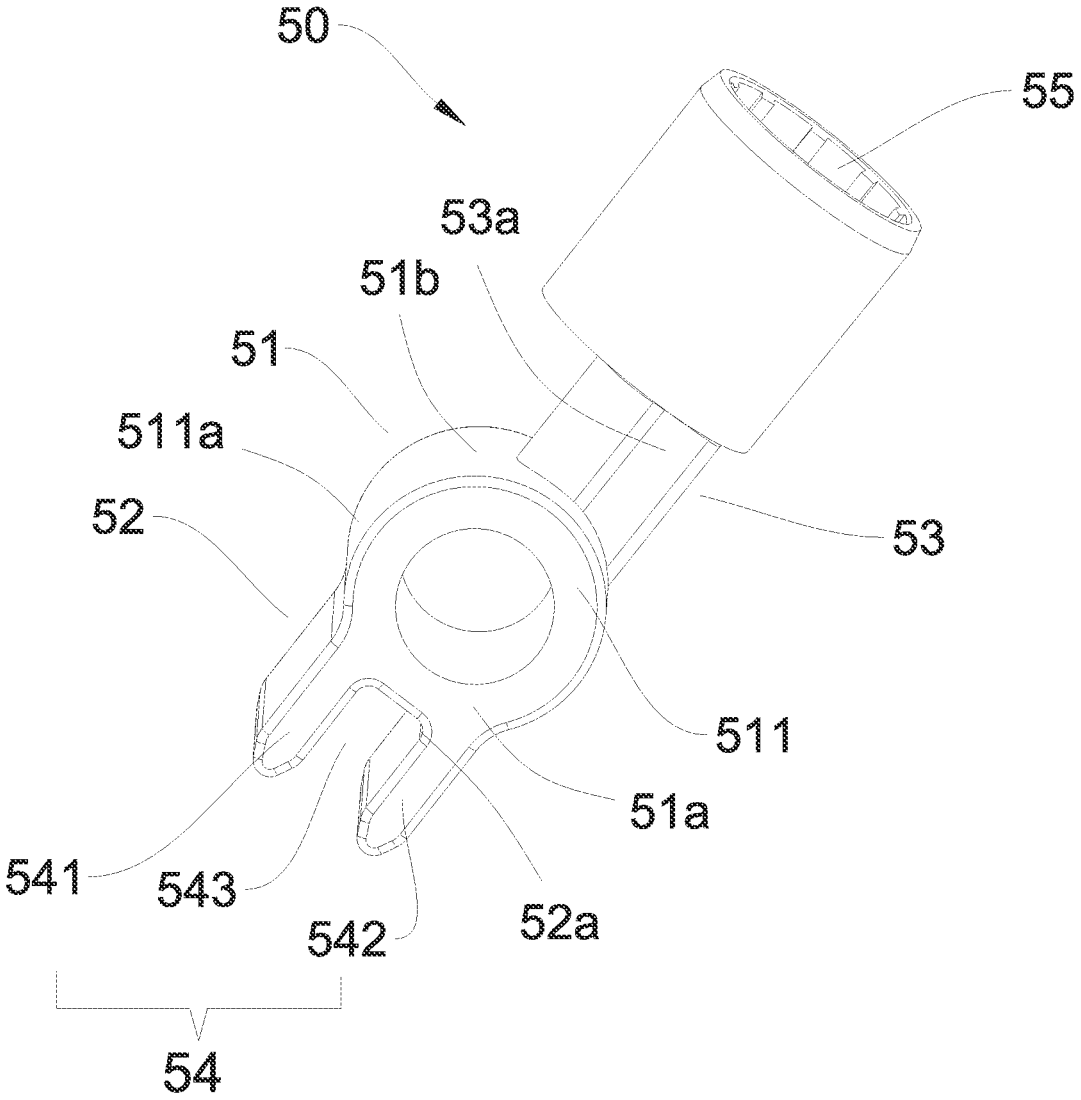
FIG. 6 is a schematic view of a nozzle member of the swinging touch massage device of FIG. 5.

As an implementation, referring to FIG. 5 and FIG. 6 the reversing member 4 is an eccentric shaft 40, and the swing rod 5 is a nozzle member 50. The nozzle member 50 includes a rotation fulcrum 51 rotationally connected with the housing 1 and a mouth structure 54 located on a first edge 51*a* of the rotation fulcrum 51, the massage protrusion 6 arranged on an opposite second edge 51*b* of the rotation fulcrum 51. A first portion 40*a* of the eccentric shaft 40 is connected with the rotary motor 3, an opposite second portion 40*b* of the eccentric shaft 40 extends into the mouth structure 54, the eccentric shaft 40 rotates to drive the mouth structure 54 to move linearly back and forth, so that the whole nozzle member 50 swings around the rotation fulcrum 51.

That is, in the first embodiment of the present, disclosure, the eccentric shaft 40 and the nozzle rod 50 are matched with each other to cooperatively convert the rotary motion of the rotary motor 3 into the reciprocating swing, and the eccentric shaft 40 rotates with the rotary motor 3, and an eccentric, part of the eccentric shaft 40 that is, the part of the eccentric shaft 40 extending into the mouth structure 54, also rotates with the rotary motor 3. In the rotation process, the eccentric part of the eccentric shaft 40 touches upper and lower inner walls or left and right inner walls of the mouth structure 54 back and forth, so that the nozzle member 50 swings back and forth around the rotation fulcrum 51.

Specifically, referring to FIG. 6, the mouth structure 54 includes a first rod 541 and an opposite second rod 542 arranged on the nozzle member 50, and a movable cavity 843 formed between the first, rod 541 and the second rod 542, the eccentric shaft 40 extending into the movable cavity 543 and in contact with the first rod 541 and the second rod 542 back and forth during the rotation process thereof, so that the mouth structure 54 moves linearly back and forth. The part of the eccentric shaft 40 extending into the movable cavity 543 is movable rather than being fixed in the movable cavity 543. During rotation, the part contacts the first rod 541 and the second rod 542 back and forth, so as to drive the mouth structure 54 to move linearly up and down or left and right, and then due to set the rotation fulcrum 51, the linear movement of the mouth structure 54 drives the whole nozzle member 50 to swing.

Figure 7:
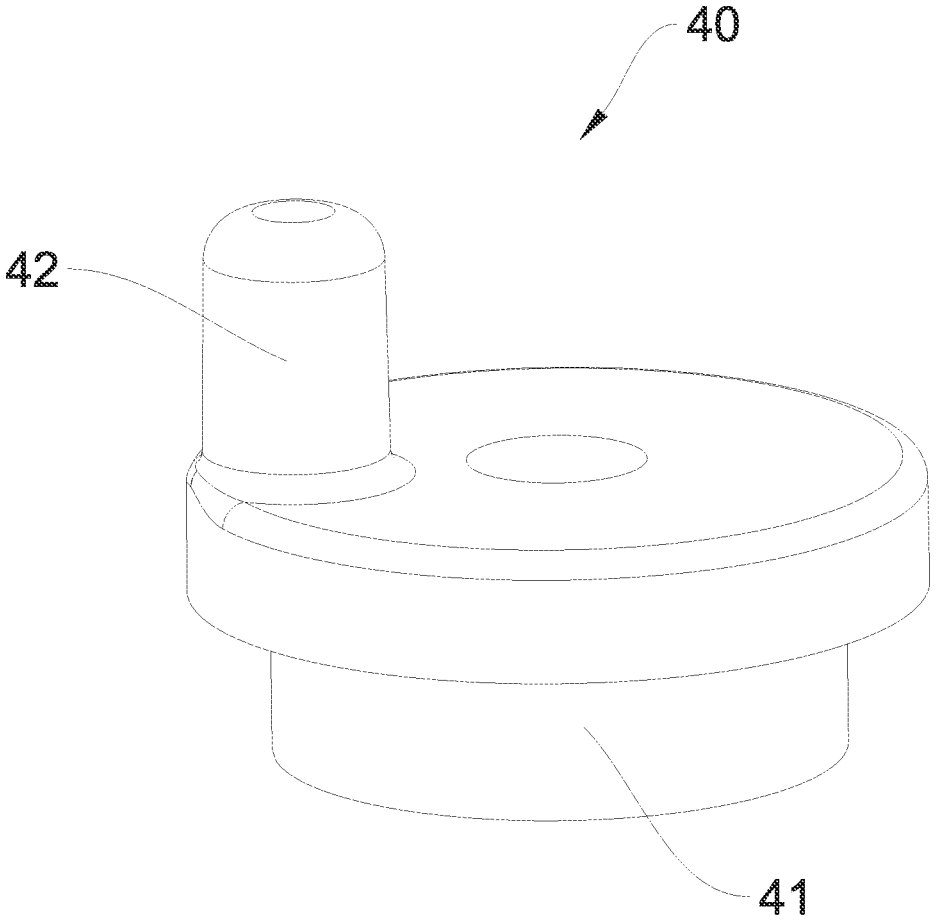
FIG. 7 is a schematic view of an eccentric shaft of the swinging touch massage device of FIG. 5.

Furthermore, referring to FIG. 7, the eccentric shaft 40 includes a first shaft 41 and a second shaft 42 eccentrically arranged on the first shaft 41, the first shaft 41 connected with the rotary motor 3, and the second shaft 42 extending into the movable cavity 543 of the mouth structure 54. The first shaft. 41 and the rotary motor 3 can be connected through a pin shaft or a key, the rotary motor 3 rotates to drive the first shaft. 41 to follow rotating, and then to further drive the eccentric second shaft 42 to rotate. Because the part of the second shaft 42 extending into the movable cavity 543 of the mouth structure 54 is movable, when the second shaft 42 rotates, the part of the second shaft 42 extending into the movable cavity 543 can repeatedly contact the first rod 541 and the second rod 542 of the mouth structure 54, for example, when the second shaft 42 rotates in an upper half circle, the part of the second shaft 42 extending into the movable cavity 543 contacts the first rod 541 and then pushes the first rod 541 from a middle position to the highest position, so that the whole nozzle member 50 completely up-swings; when the second shaft 42 rotates in a lower half circle, the part of the second shaft 42 extending into the movable cavity 543 contacts the second rod 542 and then pushes the second rod 542 from the middle position to the lowest position, so that the whole nozzle member 50 completely low-swings. In this way, the reciprocating swing of the whole nozzle member 50 is completed, so that the massage protrusion 6 arranged on the nozzle member 50 is driven to follow the reciprocating swing.

Figure 8:
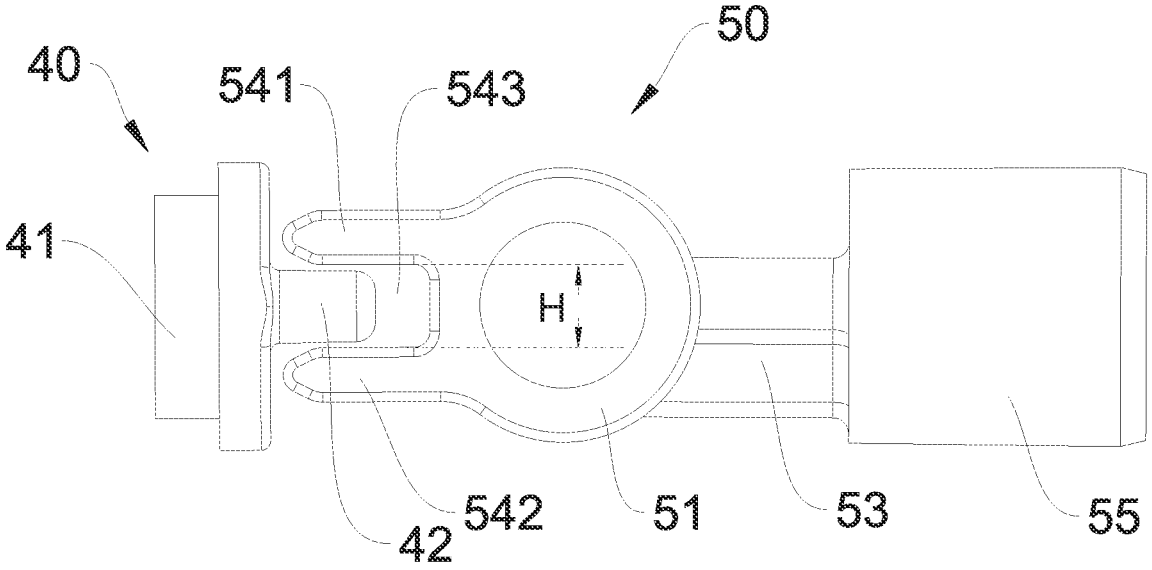
FIG. 8 is a height schematic view of a movable cavity of the swinging touch massage device of FIG. 1.
Figure 9:
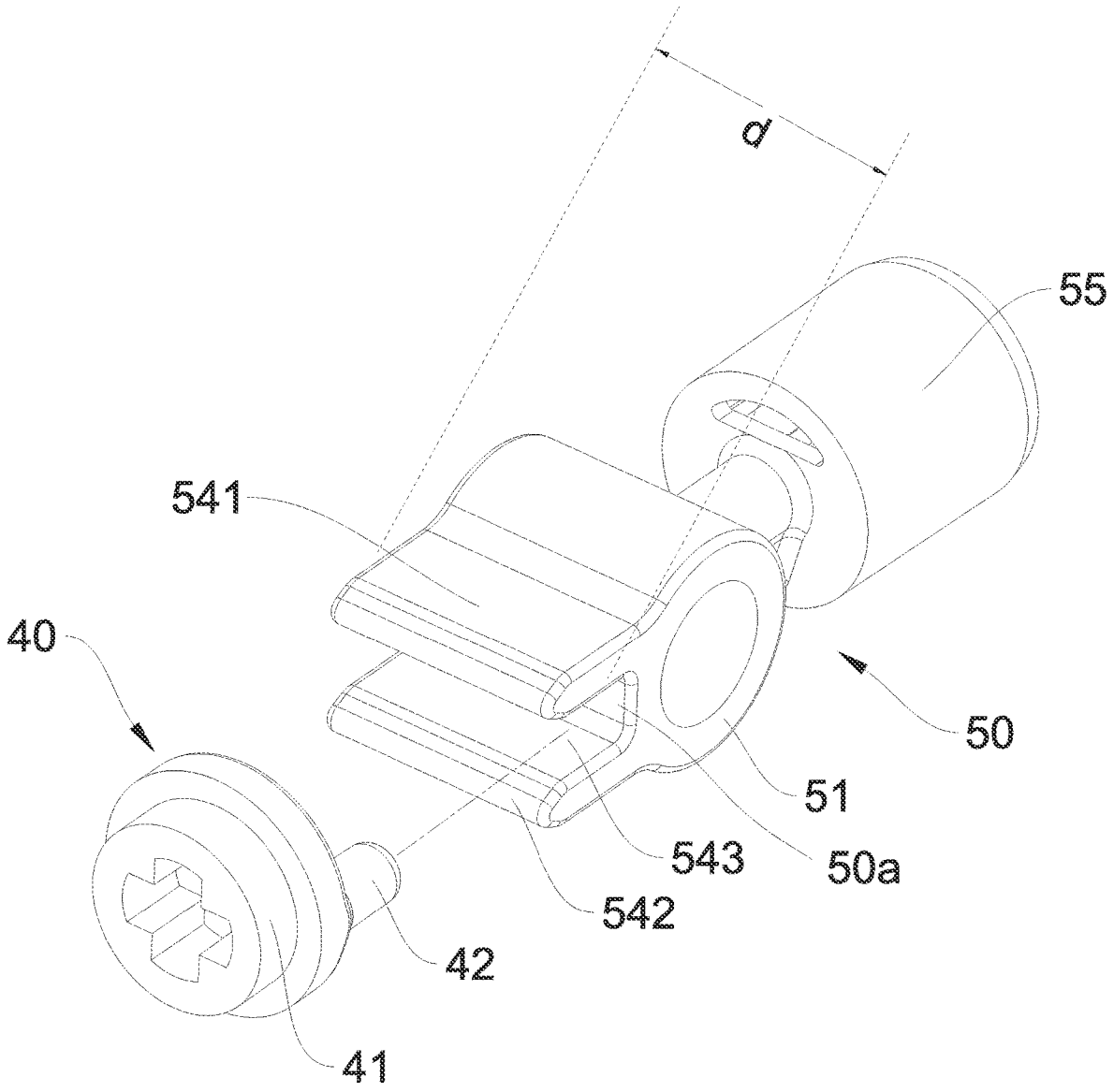
FIG. 9 is a width schematic view of the movable cavity of the swinging touch massage device of FIG. 1.

Specifically, referring to FIG. 8 and FIG. 9, in the first embodiment of the present disclosure, a height H of the movable cavity 543 is greater than or equal to a diameter of the second shaft 42, and a width d of the movable cavity 543 is greater than or equal to a distance from the leftmost position to the rightmost position of a rotation track of the second shaft 42. This not only ensures that the second shaft 42 can move flexibly in the movable cavity 543 without being jammed, but also prevents the second shaft 42 from falling out of the movable cavity 543 during rotation.

In the first embodiment of the present disclosure, the nozzle member 50 includes a rotating support pipe 511 that is taken as the rotation fulcrum 51 located in a middle thereof, and a first swing bar 52 and a second swing bar 53 respectively arranged on a sidewall 511*a* of the rotating support pipe 511 the rotating support pipe 511 rotationally installed on the housing 1, the mouth structure 54 arranged at one end 52*a* of the first swing bar 52 away from the rotating support pipe 511, and the massage protrusion 6 arranged on the second swing bar 53. That is, the mouth structure 54 is arranged on the first end 50*a* of the nozzle member 50, and the massage protrusion 6 is arranged on the opposite second end 50*b* of the nozzle member 50, to drive the massage protrusion 6 to swing, and the middle of the nozzle member 50 is taken as the rotation fulcrum 51. Specifically, the first hard shell 111 of the present embodiment is provided with a rotating shaft 1111, and the rotating support pipe 511 is a hollow pipe sleeved on the rotating shaft 1111, so that the whole nozzle member 50 can swing around the rotating shaft 1111. It can be understood that the nozzle member 50 can also be provided with the mouth structure 54 directly on one sidewall of the rotating support pipe 511 and the second swing bar 53 on the other opposite sidewall without setting the first swing bar 52.

Preferably, referring to FIG. 5 and FIG. 6, a first vibration motor 71 is arranged on a distal end 53*a* of the second swing bar 53, the massage protrusion 6 is a hollow structure and sleeved on the first vibration motor 71. The first vibration motor 71 is controlled by the circuit board 16. Specifically, as shown in FIG. 6, the distal end 53*a* of the second swing bar 53 of the present embodiment is provided with a sleeve 55 for installing the first vibration motor 71 thereon. The first vibration motor 71 is served as a lengthened part of the second swing bar 53, when the second swing bar 53 swings, the first vibration motor 71 is also followed to swing, so that the massage protrusion 6 arranged outside the first vibration motor 71 is driven to swing, at the same time, the first vibration motor 71 has a vibration function, so that the massage protrusion 6 also follows to vibrate, so that the massage protrusion 6 of the present embodiment can swing and vibrate, so that the massage protrusion 6 can perform both the swing motion and the vibration motion at the same time or separately perform each of the swing motion and the vibration motion, to improve massage experiences.

Figure 2:
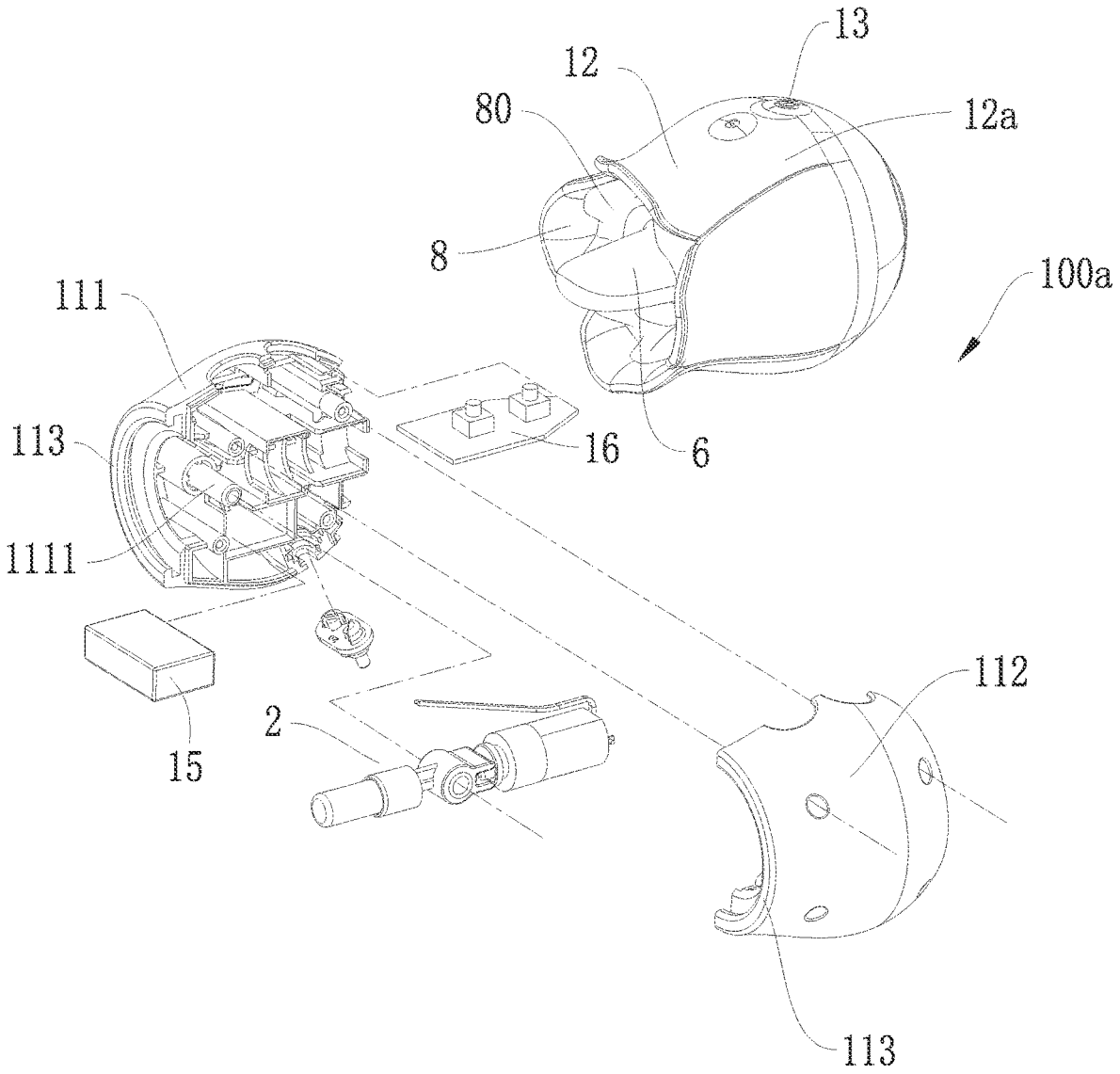
FIG. 2 is an exploded, schematic view of the swinging touch massage device of FIG. 1.

Referring to FIGS. 1-3, a cover 8 is arranged on one end 1*b* of the housing 1, specifically, the cover 8 is bell-shaped configuration, and the massage protrusion 6 is exposed outside from the cover 8. The cover 8 protrudes outside from the end 1*b* of the housing 1. Specifically, the cover 8 is installed at the opening 113 of the housing 1. A chamber 80 is formed on the cover 8, and the massage protrusion 6 extends outside from the chamber 80 of the cover 8.

The cover 8 can be abutted against a massage part of the human body to position and support the massage device 100*a* thereon. In the first embodiment, the cover 8 is integrated with the soft shell 12, and furthermore, or all the cover 8, the soft shell 12 and the massage protrusion 6 are integrated with each other.

Figure 10:
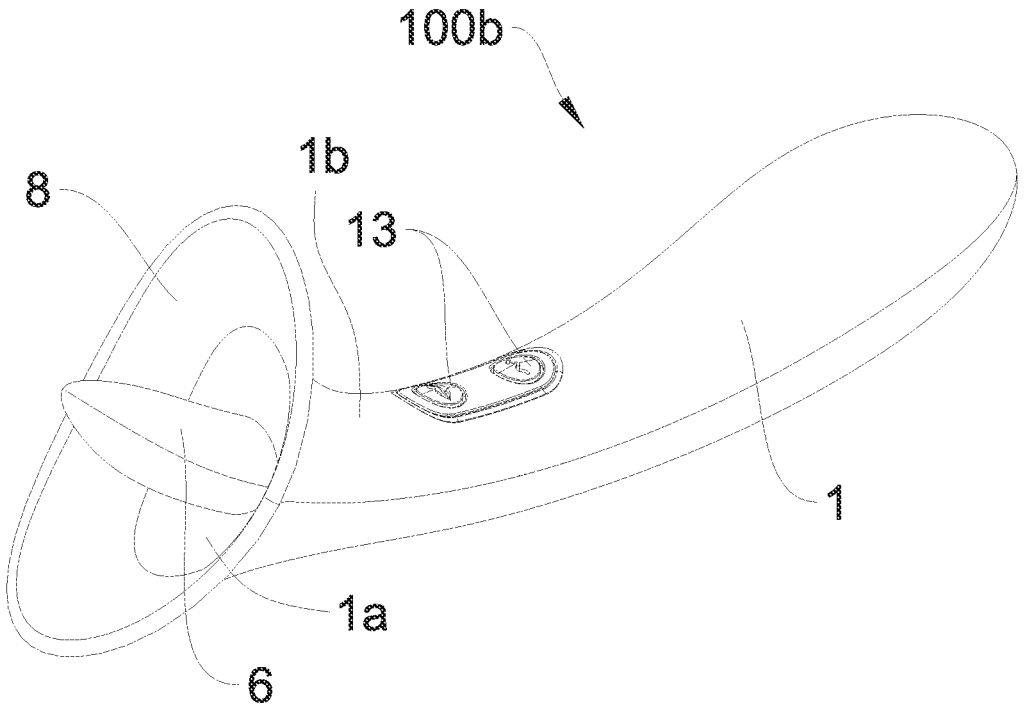
FIG. 10 is a schematic view of the swinging touch massage device in accordance with a second embodiment of the present disclosure.
Figure 11:
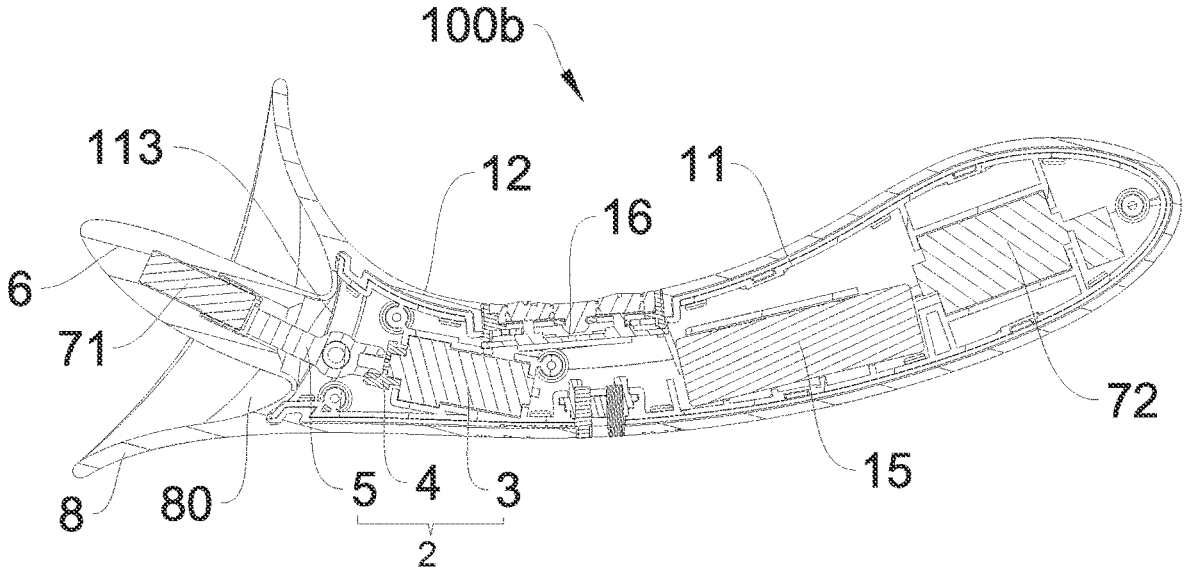
FIG. 11 is a cross section view of the swinging touch massage device of FIG. 10.

Referring to FIG. 10 and FIG. 11, a swinging touch massage device 100*b* in accordance with a second embodiment of the present disclosure is provided. A difference of the swinging touch massage device 100*b* of the second embodiment from the swing touch massage device 100*a* of the first embodiment is that: in the second embodiment, the housing 1 is a rod-shaped configuration, and a second vibration motor 72 is arranged on, an end of the rod-shaped housing 1 away from the massage protrusion 6. The second vibration motor 72 is provided that the housing 1 of the swing touch massage device 100*b* also have the effect of vibration massage.

Figure 12:
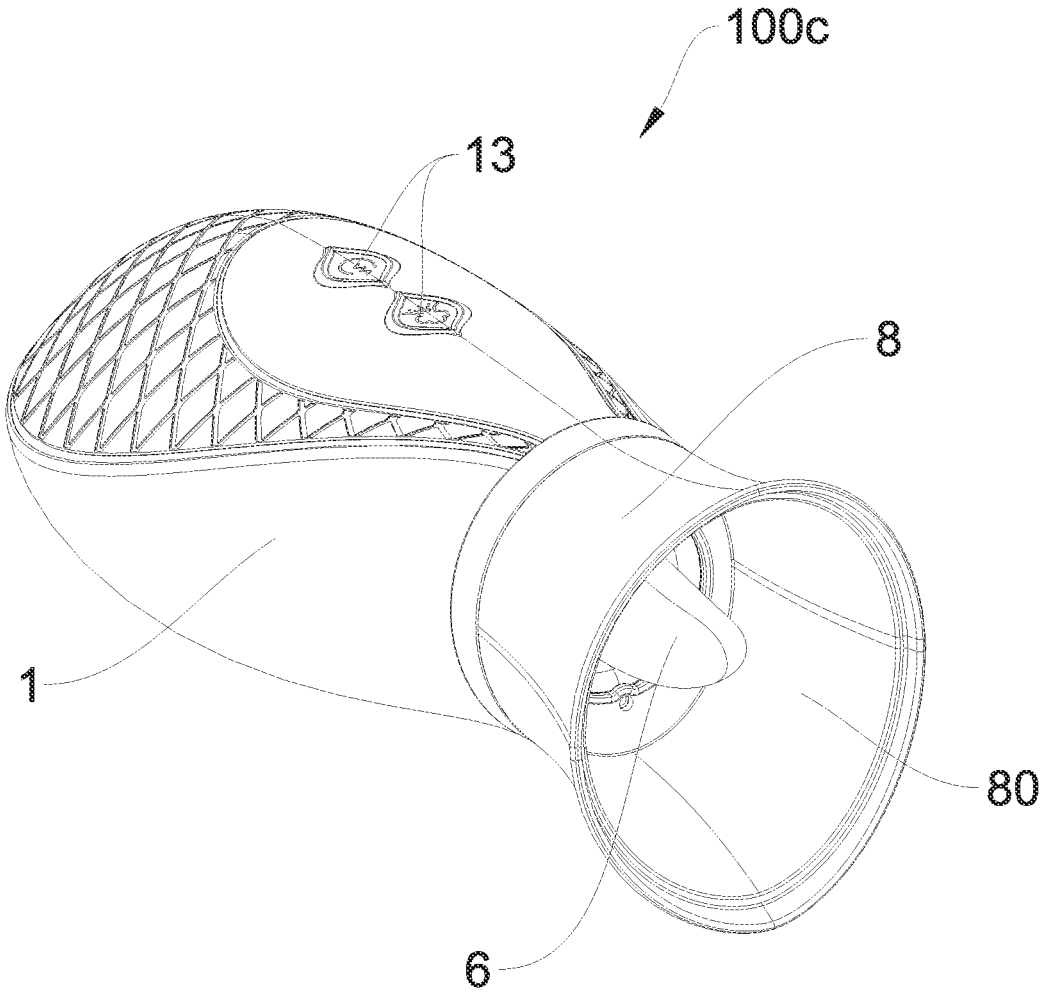
FIG. 12 is a schematic view of the swinging touch massage device in accordance with a third embodiment of the present disclosure.
Figure 13:
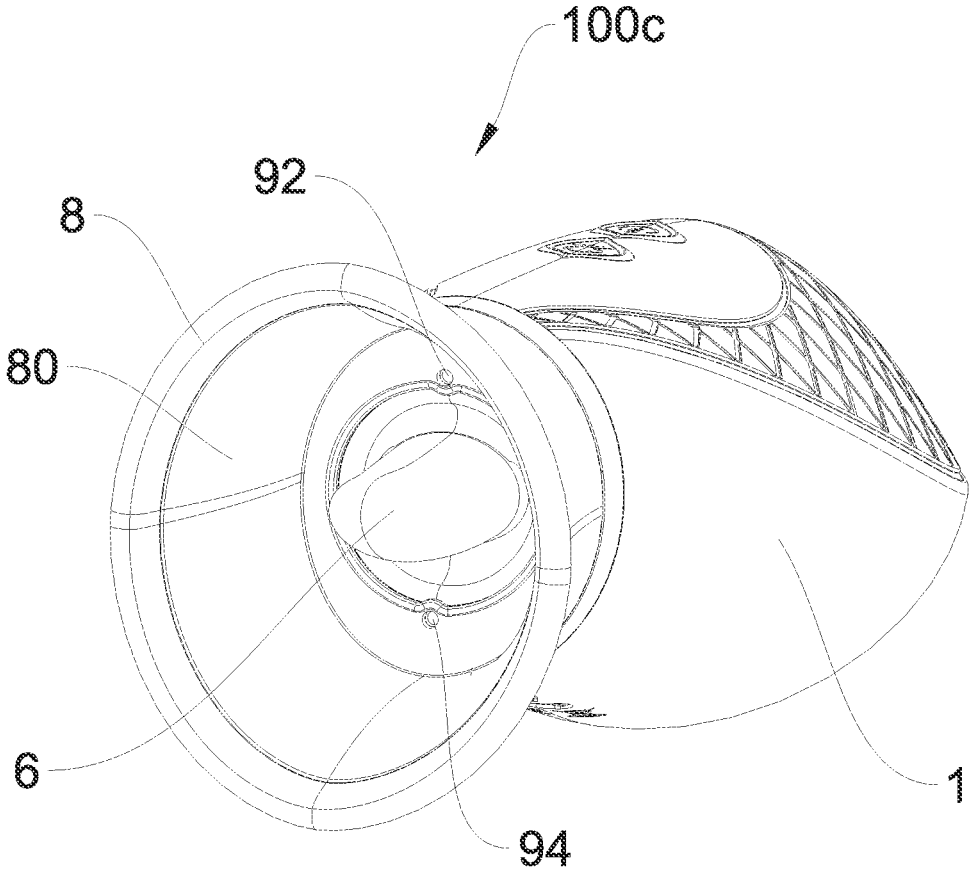
FIG. 13 is a schematic view of the swinging touch massage device of FIG. 12, but shown from another view.
Figure 14:
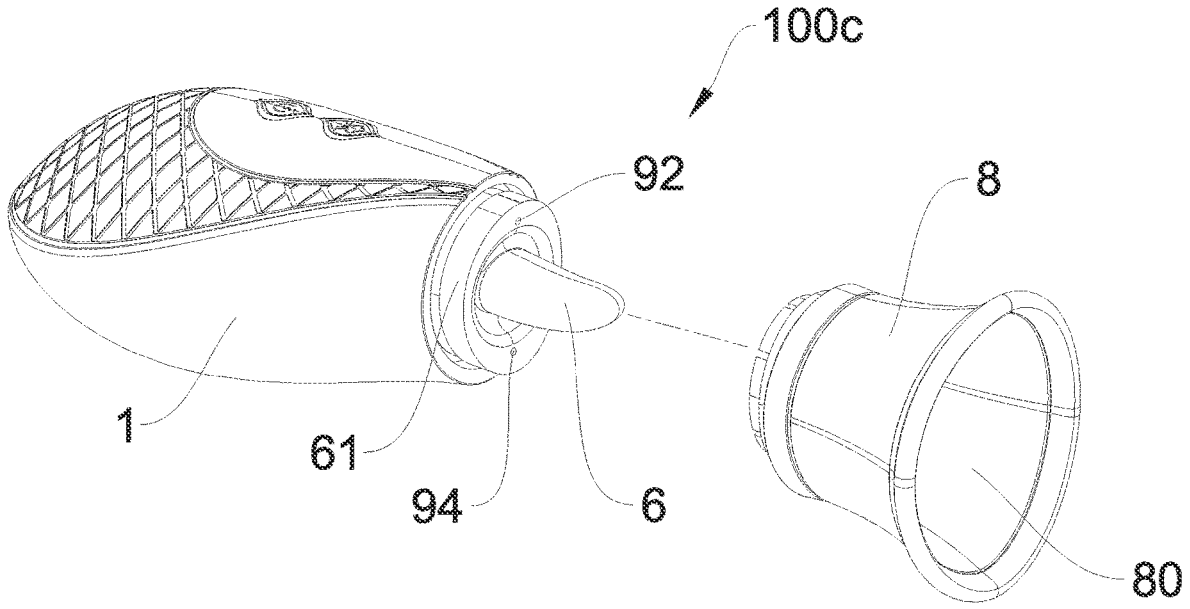
FIG. 14 is a first exploded, schematic view of the swinging touch massage device of FIG. 12.
Figure 15:
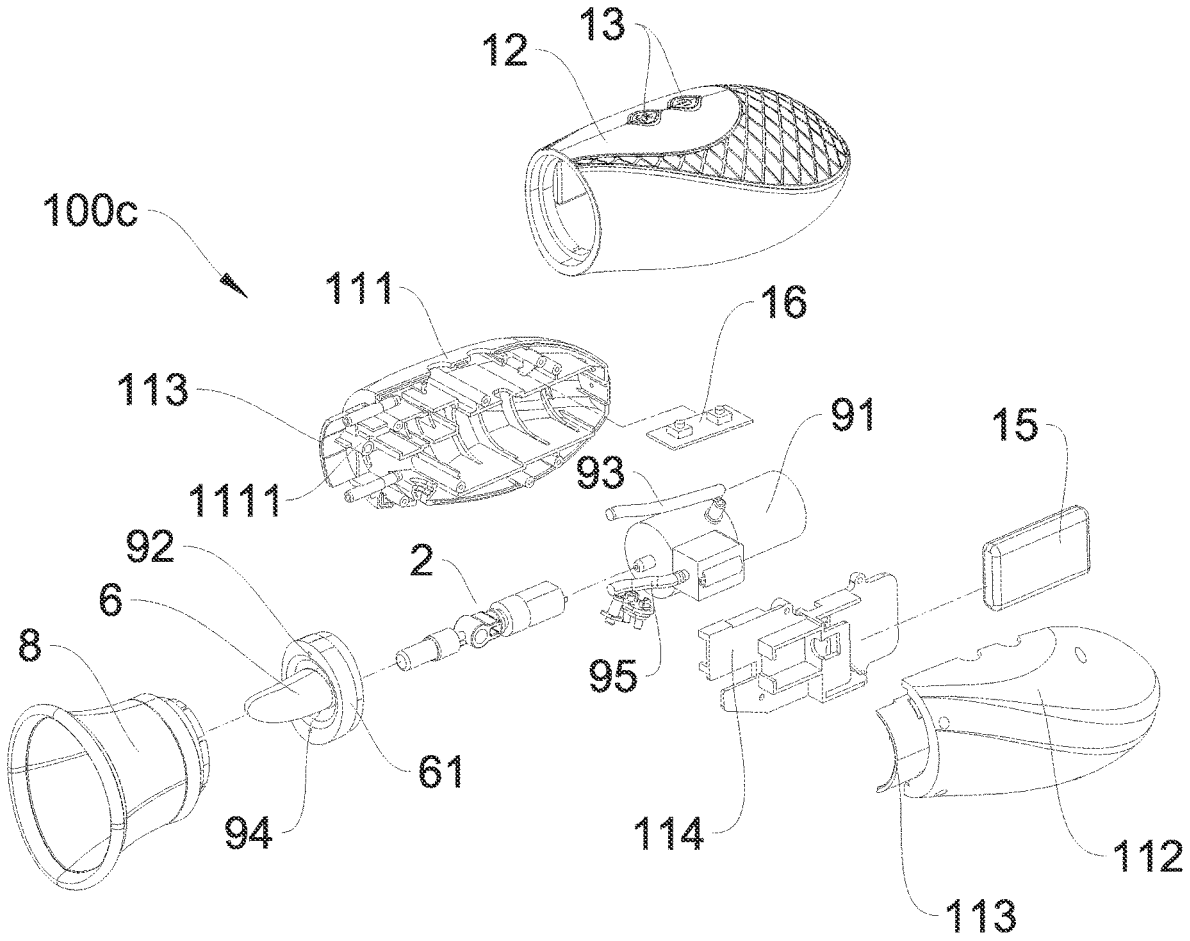
FIG. 15 is a second exploded, schematic view of the swinging touch massage device of FIG. 12.
Figure 16:
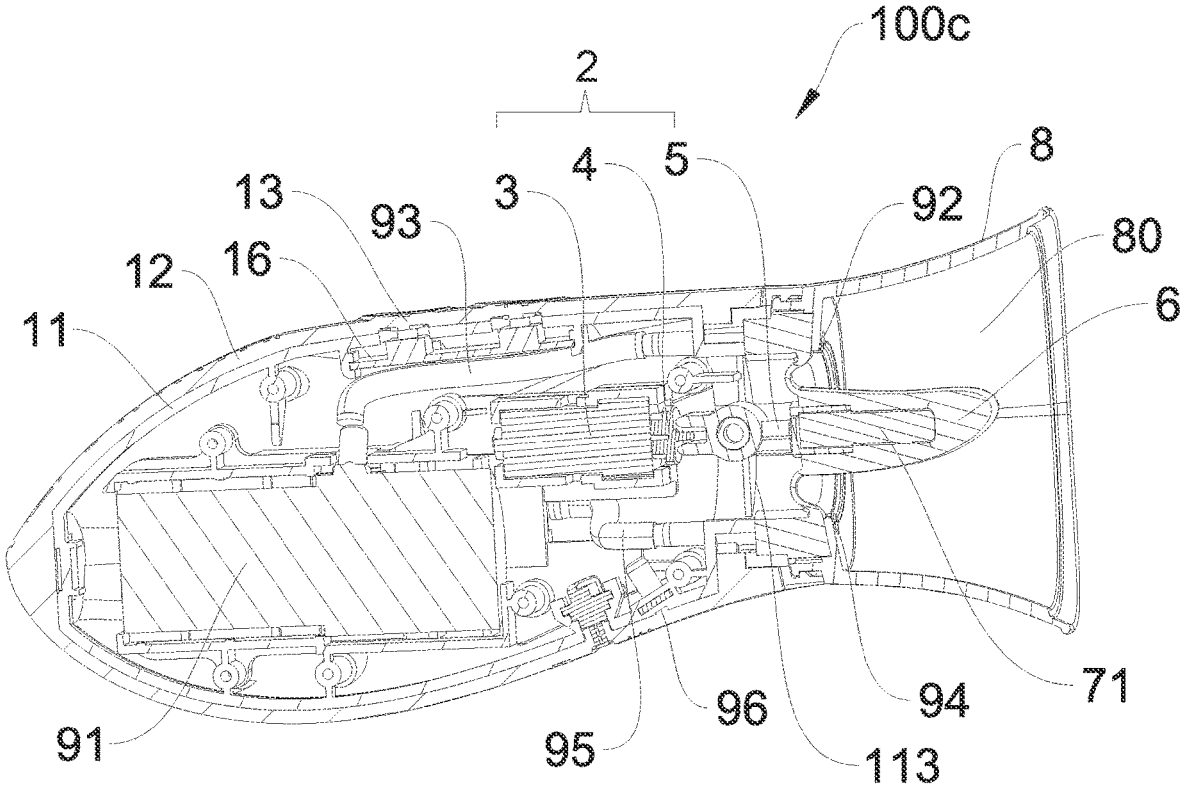
FIG. 16 is a cross section view of the swinging touch massage device of FIG. 12.

Referring to FIG. 12 and FIG. 16, a swinging touch massage device 100*e* in accordance with a third embodiment of the present disclosure is provided. A difference of the swinging touch massage device 100*e* of the third embodiment from the swing touch massage device 100*a* of the first embodiment is that: in the third embodiment, an air pump 91 is installed in the housing 1, a suction hole 92 arranged at a connection end of the housing 1 and the cover 8, and a suction pipe 93 connected between the suction hole 92 and the air pump 91. Meanwhile, another difference between the swing touch massage device 100*c* of e the third embodiment from the swing touch massage device 100*a* of the first embodiment is that: in the third embodiment, the cover 8 is an independent structure, which is detachably connected with the housing 1, that is, the cover 8 is detachably connected with the soft shell 12 and the hard shell 11, so as to conveniently replace the cover 8. It can be understood that the cover 8 and the housing 1 of the present embodiment can also be integrated with each, other. After the cover 8 of the third embodiment abuts against the massage part of the human body, the massage part is fainted a sealed space by the cover 8 and the human body, and then, after opening the air pump 91, air in the sealed space flows into the suction hole 92 from the chamber 80 of the cover 8, and then enters the air pump 91 through the suction pipe 93, and finally the air is discharged out of the housing 1 through the air pump 91, for example, the air is discharged from a vent 96 shown in FIG. 16. The air pump 91 is powered by the battery 15 and controlled to start and stop by the circuit board 16. A frame 114 is arranged in the housing 1 of the third embodiment to install components such as the air pump 91 and the battery 15 thereon.

In this way, the swing touch massage device 100*c* of the third embodiment can perform adsorption massage on the human body by the cover 8 abutting against the human body, such as intermittent inhalation, which can obtain the effect of one suction and one release. Combined with the swing massage of the massage protrusion 6, or combined with the swing and vibration massage of the massage protrusion 6, the massage experience can be improved.

A bottom of the massage protrusion 6 of the third embodiment is provided with a base 61 that is integrated with the massage protrusion 6, which is installed at the opening 113 at the same end of the hard shell 11 and the soft shell 12 to seal opening ends of the hard shell 11 and the soft shell 12, and the suction hole 92 passes through the base 61 to connect the suction pipe 93 of the hard shell 11 with the chamber 80 of the cover 8.

Furthermore, an outlet 94 is arranged at a connection end of the housing 1 and the cover 8, and an outlet pipe 95 is connected between the outlet 94 and the air pump 91. Specifically, the air outlet 94 passes through the base 61, the air outlet 94 enables the air pump 91 to blow air into the chamber 80 of the cover 8, so that the air can be quickly released into the chamber 80 after adsorption to balance an air pressure of the chamber 80, so as to quickly release the adsorption part. At the same time, it can also blow air to massage the part of the human body that has been abutted against the cover 8.

Figure 17:
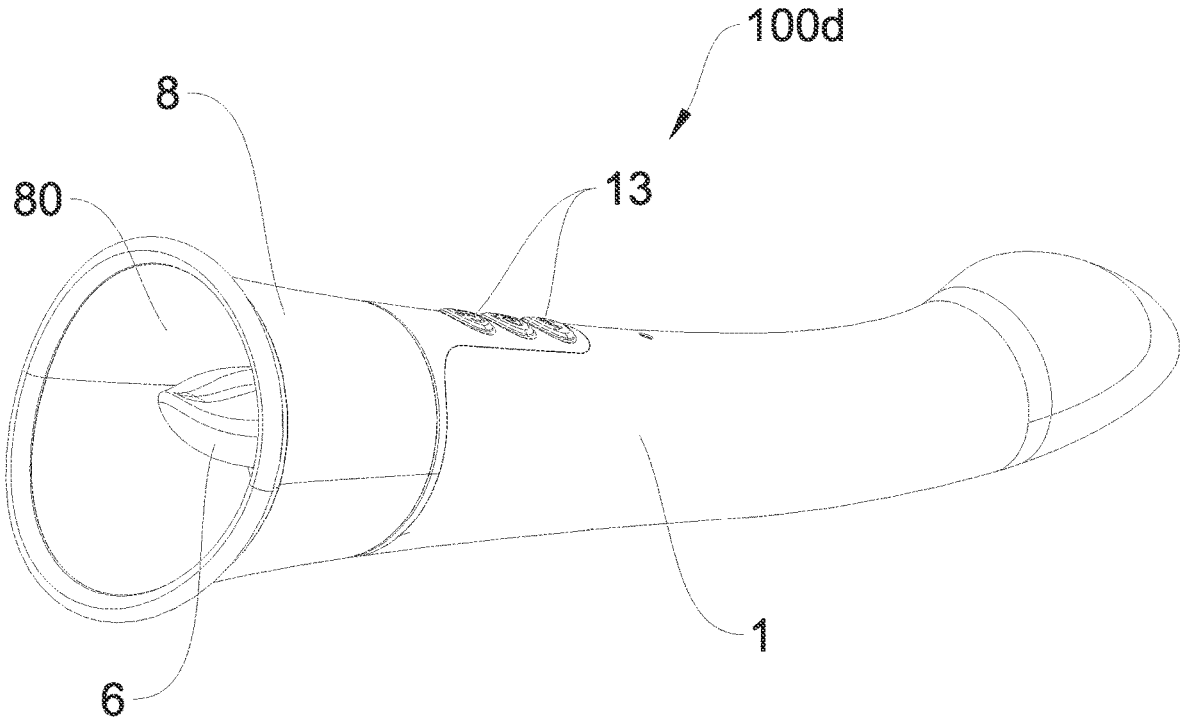
FIG. 17 is a schematic view of the swinging touch massage device in accordance with a fourth embodiment of the present disclosure.
Figure 18:
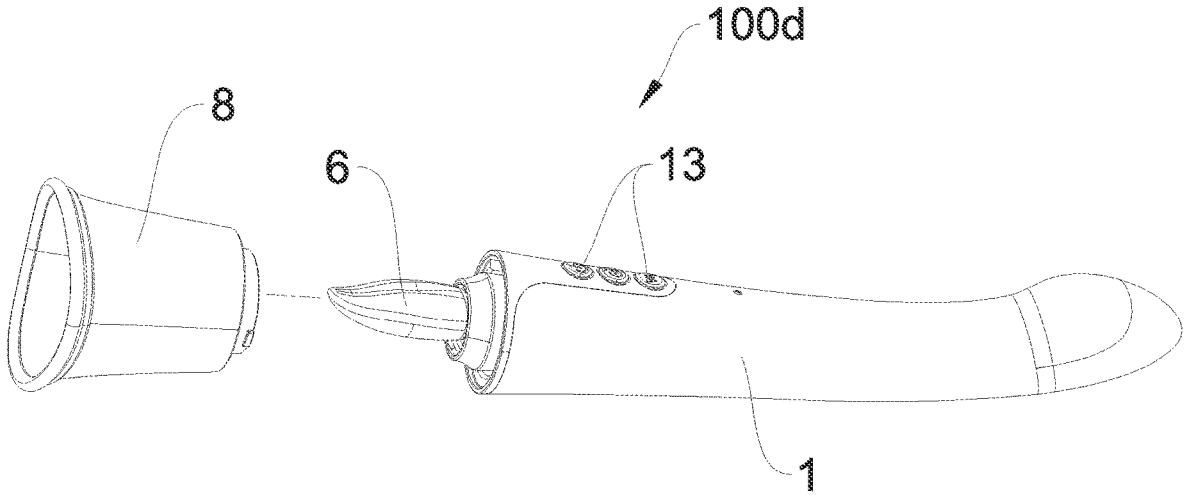
FIG. 18 is a first exploded, schematic view of the swinging touch massage device of FIG. 17.
Figure 19:
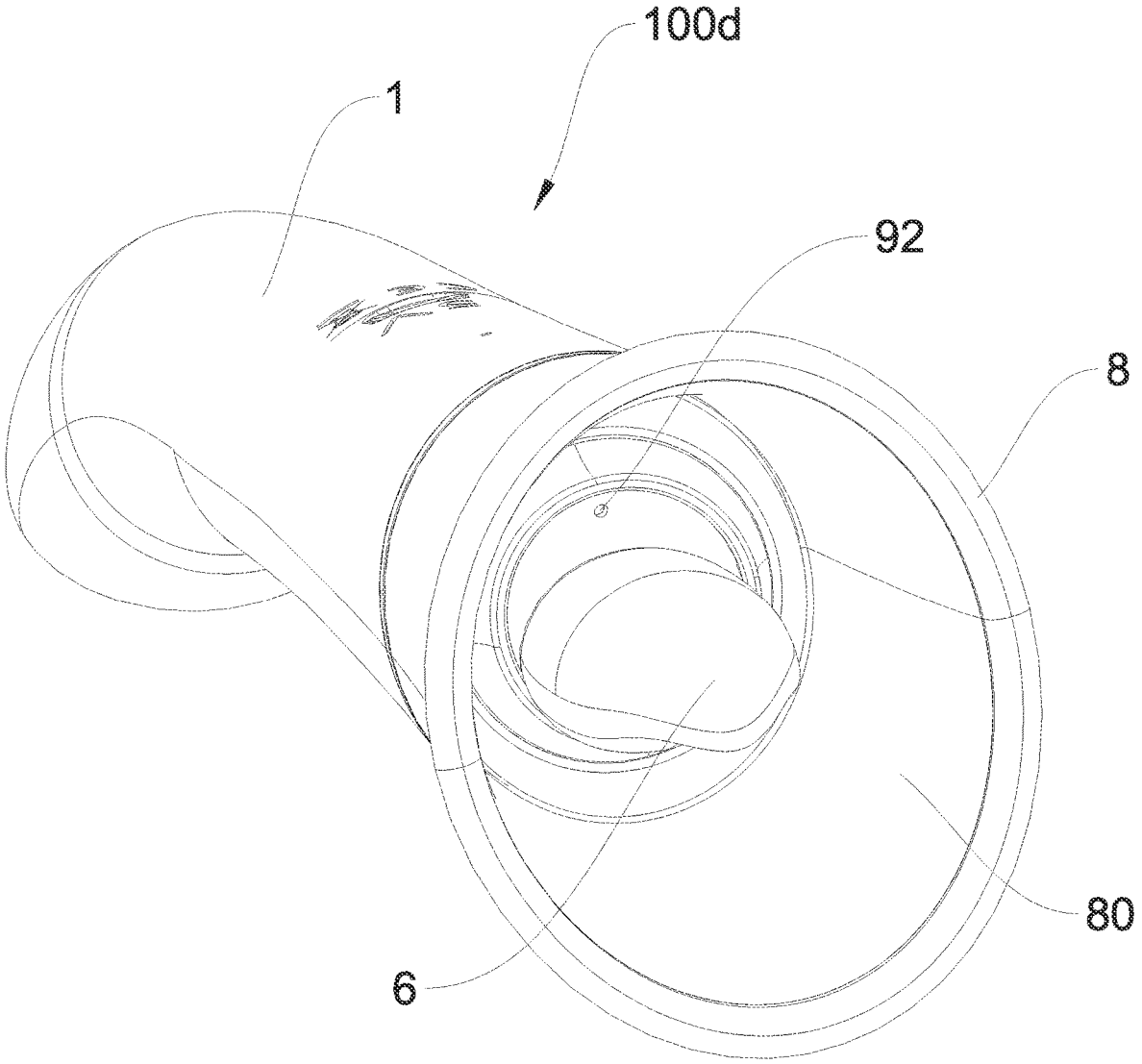
FIG. 19 is a schematic view of the swinging touch massage device of FIG. 17, but shown from another view.
Figure 20:
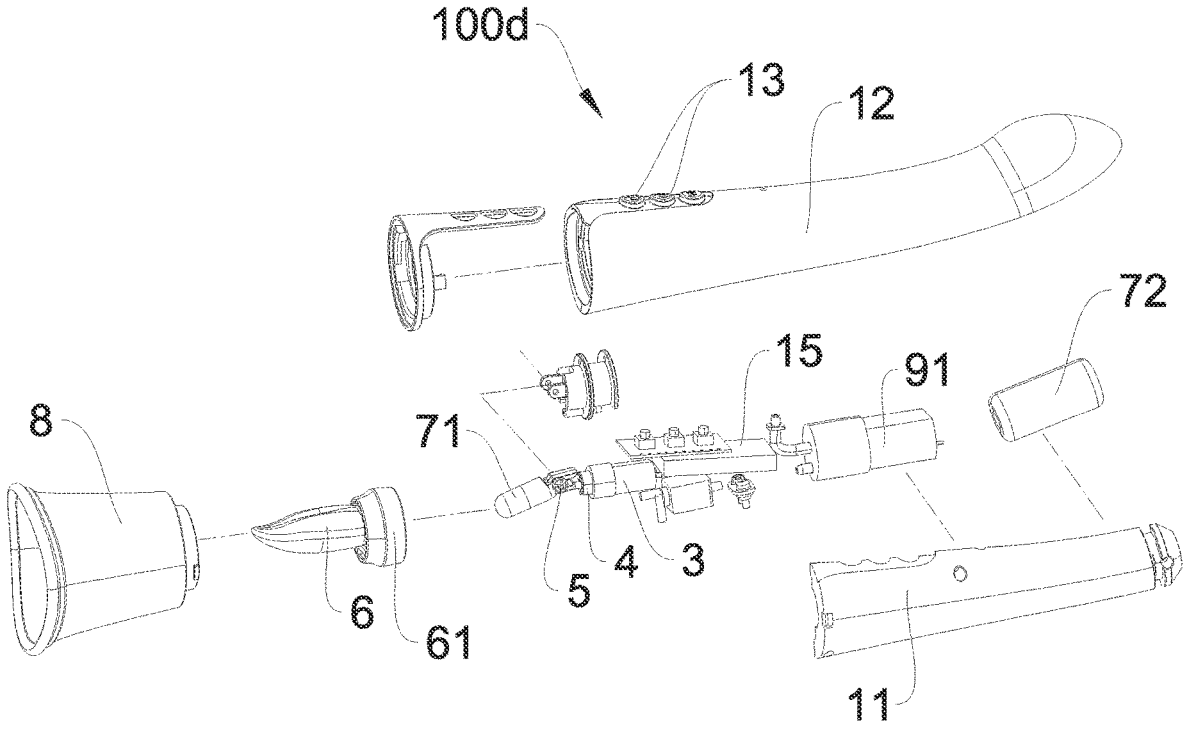
FIG. 20 is a second exploded, schematic view of the swinging touch, massage device of FIG. 17.

Referring to FIG. 17 and FIG. 20, a swinging touch massage device 100*d* in accordance with a fourth embodiment of the present disclosure is provided. A difference of the swinging touch massage device 100*d* of the fourth embodiment from the swing touch massage device 100*c* of the third embodiment is that: in the fourth embodiment, the housing 1 is a rod-shaped configuration, and a second vibration motor 72 is arranged on an end of the rod-shaped housing 1 away from the massage protrusion 6. The second vibration motor 72 is provided that the housing 1 of the swing touch massage device 100*d* also have the effect of vibration massage to prompt the massage experience. At the same time, another difference between the fourth embodiment and the third embodiment is that: the swing touch massage device 100*d* of the fourth embodiment is provided that only the suction hole 92 is formed at the connection end of the housing 1 and the cover 8, rather than providing the outlet 94.

The swinging touch massage device 100*a*, 100*b*, 100*c*, 100*d* of the present disclosure is provided that all the rotary motor 3, the reversing member 4 and the swing rod 5 are set as the swing member 2 to be received in the housing 1, the massage protrusion 6 arranged on the swing rod 5, the reversing member 4 connected with the rotary motor 3 and the swing rod 5, so that the rotary motion of the rotary motor 3 is converted into the reciprocating swing of the swing rod 5, so as to drive the massage protrusion 6 of the swing rod 5 to swing back and forth for massaging the human body, in this way, the massage device 100*a*, 100*b*, 100*c*, 100*d* of the present disclosure performs swing touch massage through the swing member 2, which will not cause stagnation, and has better vibration massage effect compared with a single motor vibration, so as to improve usage experiences.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A swinging touch massage device comprising:

a housing and a swing member received in the housing;

the swing member comprising a rotary motor, a reversing member and a swing rod, two opposite ends of the reversing member respectively connected with the rotary motor and the swing rod, the reversing member configured to convert a rotary motion of the rotary motor into a reciprocating swing of the swing rod; and wherein a massage protrusion is arranged at one end of the swing rod away from the reversing member, and protrudes outwardly from a surface of the housing to swing back and forth with the swing rod, wherein the reversing member is an eccentric shaft, the swing rod is a nozzle member, the nozzle member comprising a rotation fulcrum rotationally connected with the housing and a mouth structure that formed a first edge of the rotation fulcrum, the massage protrusion arranged on an opposite second edge of the rotation fulcrum; and a first portion of the eccentric shaft connected with the rotary motor, an opposite second portion of the eccentric shaft extending into the mouth structure, the eccentric shaft rotated to drive the mouth structure to move linearly back and forth, so that the whole nozzle member swings around the rotation fulcrum, wherein the swing rod comprises a sleeve having a mouth, the mouth of the sleeve is configured to receive a first vibration motor, the first vibration motor forming the second edge, wherein the first vibration motor and the sleeve are received within a soft shell of the housing, and wherein a portion of the soft shell that covers the first vibration motor and the sleeve form the massage protrusion, wherein the soft shell integrally formed a bell-shaped cover that encircle the massage protrusion and the massage protrusion is exposed to an outside through the bell-shaped cover, and the soft shell sleeved on a hard shell of the housing and substantially covered the hard shell.

2. The swinging touch massage device as claimed in claim 1, wherein the mouth structure comprises a first rod and an opposite second rod arranged on the nozzle member, and a movable cavity formed between the first rod and the second rod, the eccentric shaft extending into the movable cavity and in contact with the first rod and the second rod back and forth during a rotation process thereof, so that the mouth structure moves linearly back and forth.

3. The swinging touch massage device as claimed in claim 2, wherein the eccentric shaft comprises a first shaft and a second shaft eccentrically arranged on the first shaft, the first shaft connected with the rotary motor, and the second shaft extending into the movable cavity of the mouth structure.

4. The swinging touch massage device as claimed in claim 3, wherein a height of the movable cavity is greater than or equal to a diameter of the second shaft, and a width of the movable cavity is greater than or equal to a distance from a leftmost position to a rightmost position of a rotation track of the second shaft.

5. The swinging touch massage device as claimed in claim 1, wherein the nozzle member comprises a rotating support pipe that is taken as the rotation fulcrum located in a middle portion of the nozzle member, and a first swing bar and a second swing bar respectively arranged on a sidewall of the rotating support pipe, the rotating support pipe rotationally installed on the housing, the mouth structure arranged at one end of the first swing bar away from the rotating support pipe.

6. The swinging touch massage device as claimed in claim 1, wherein the massage protrusion is a tongue-shaped configuration or a finger-shaped configuration.

7. The swinging touch massage device as claimed in claim 1, wherein an opening arranged on one end of the hard shell, the swing rod extending outside from the opening, and the cover arranged adjacent to the opening.

8. The swinging touch massage device as claimed in claim 1, wherein the housing is a rod-shaped configuration, and a second vibration motor is arranged on an end of the rod-shaped housing away from the massage protrusion.

9. The swinging touch massage device as claimed in claim 1, wherein the hard shell is made of plastic, and the soft shell is made of silica gel; a key and a charging interface are arranged on a surface of the soft shell, the swing member arranged in the hard shell, both a battery and a circuit board are being received in the hard shell, and the battery configured to supply power to the circuit board and the swing member.

* * * * *